United States Patent [19]

Hickey

[11] 4,305,505

[45] Dec. 15, 1981

[54] TRANSPORT OF PALLETIZED LOADS IN CONTAINERS

[75] Inventor: Christopher D. D. Hickey, Esher, England

[73] Assignee: Airflex Containers Limited, Ashford, England

[21] Appl. No.: 107,079

[22] Filed: Dec. 26, 1979

[30] Foreign Application Priority Data

Dec. 27, 1978 [GB] United Kingdom ..... 50040/78

[51] Int. Cl.[3] ..... B65D 19/00

[52] U.S. Cl. ..... 206/599; 206/600; 108/54.1; 108/55.1; 108/56.3

[58] Field of Search ..... 206/386, 599, 600; 108/54.1, 55.1, 55.3, 55.5, 56.1, 56.3

[56] References Cited

U.S. PATENT DOCUMENTS

| | | | |
|---|---|---|---|
| 3,169,471 | 2/1965 | McLean | 206/599 |
| 3,204,385 | 9/1965 | Remer et al. | 206/599 |
| 4,007,833 | 2/1977 | Bigelow, Jr. | 206/600 |
| 4,124,119 | 11/1978 | Nordstrom | 206/600 |

*Primary Examiner*—Joseph Man-Fu Moy
*Attorney, Agent, or Firm*—Young & Thompson

[57] ABSTRACT

For transporting palletized loads in a container, such as a standard shipping container, a pallet securing kit is provided comprising flanged members which are held against two side walls of the container by an end spreader bar and are held down on the base of the container by adjustable struts so that a loaded pallet or pallets may be slid along the floor with its peripheral edges retained under flanges on said flanged members, the pallets being secured by a closure member fitted between the flanged members to hold the pallet or pallets in position.

13 Claims, 3 Drawing Figures

TRANSPORT OF PALLETIZED LOADS IN CONTAINERS

BACKGROUND OF THE INVENTION

This invention relates to the transport of palletised loads in containers.

It is well-known to utilise standard-sized containers for the transport of goods. These goods have to be stowed and secured in the container. It is also known to put goods on a pallet for transport or storage.

BRIEF SUMMARY OF THE INVENTION

It is one of the objects of the present invention to provide means facilitating the securing, in a container, of one or more pallets having goods thereon.

According to one aspect of the present invention, pallet-securing means are provided for fitting within a container of predetermined dimensions and rectangular in plan to secure therein one or more pallets of predetermined dimensions, which pallet-securing means comprise two flanged members adapted to extend along the length of the floor of the container, one on each side thereof with the flanges extending inwardly towards one another above floor level, which flanges are at a height above the floor level to permit of a pallet or pallets sliding under a flange on each flanged member to be retained against upward movement thereby, a first cross-member adapted to be inserted between the flanged members at one end of the container to hold the flanged members against the respective side walls of the container, props arranged between each flanged member and a respective pad or pads adapted for bearing against the roof of the container for holding the flanged members down onto the floor of the container and a closure element adapted to be secured between the flanged members to form a second cross-member spaced from said first cross-member.

With these pallet-securing means, when it is required to transport palletised goods in a container, the two flanged members are put in the container, one on each side thereof to extend along the length of the container and the first cross-member is put between these flanged members at the far end of the container, that is the end remote from the door or access end so as to hold the flange members apart. This first cross-member in practice may be a simple beam which, when put straight across between the flanged members, wedges them tightly against the side walls of the container. It will be understood that containers are made in standard sizes and the pallet-securing means would be dimensioned to fit a particular container. If necessary however, adjusting means, e.g. threaded adjusting means may be provided on the first cross-member to enable it to be tightened against the flanged members so as to hold them tightly against the sides of the container.

The flanged members conveniently are channel members which are disposed with the base of the channel lying against the side wall and with one arm lying on the floor of the container and the other arm forming the flange located above the floor of the container.

The props may be dimensioned so as to be a force fit since the pallet-securing means would be used witha container of predetermined size. Preferably, however, the props are adjustable in length. The adjustable props may be secured to or attached to the flanged members and adjusted so as to force a pad or pads against the roof of the container and hence hold the flanged members downwardly on the floor. In the simplest form these adjustable means may comprise adjustable struts, e.g. with a threaded adjustment, each strut extending between a pad and the associated flanged member. A single such strut may be provided for each flanged member. It may be preferred however to utilise, for each flanged member, a single pad supported by two adjustable struts extending between the pad and spaced points on the flanged member.

The closure member is inserted between the two flanged members after the pallet or pallets have been put in position. The pallet or pallets would be slid under the flanges into the container as far as possible. Unless some other stop is provided, the pallets would by pushed up against the first cross member. The closure member is secured to the flanged members by any convenient means. It will be appreciated that, since the pallets are of standard sizes, it would merely be necessary to provide fixing means at one or more appropriate points. Commonly the container would be of a size to hold several pallets and provision would be made for securing the closure member in the appropriate position to secure one or more than one pallet. These securing means may for example be bolts or clamps or other fixing means. A particularly convenient and simple construction however is to provide slots in the flanges of the flanged members into which the closure member may be put so that it is restrained against movement longitudinally of the flanged members. Clips or other retaining devices may be provided to secure the closure against accidental lifting out of the slots.

It may be preferable to provide threaded adjusting means on the closure member to enable the pallets to be tightly compressed towards the far end of the container after the closure member has been secured in position. Such adjusting means enable the pallets to be held tightly whilst allowing sufficient tolerances to enable the closure member to be readily secured with its fixing means.

The invention furthermore includes within its scope a container provided with pallet-securing means as described above.

The pallet-securing means of the present invention find particular application in securing, in a container, pallets of the kind having an impermeable pallet with an impermeable flexible cover sheet sealed to the pallet whereby the space between the cover sheet and the goods may be partially evacuated so that the cover is pressed down by air pressure to hold the goods tightly on the pallet. Reference may be made to U.S. Pat. Nos. 3,850,214; 4,114,668 and 4,140,237 as disclosing examples of such containers. Such an arrangement finds particular application for the transport and storage of goods, particularly complex or delicate technical equipment or other goods requiring careful handling but which have to be readily available for use. On releasing the vacuum, the cover may be removed to expose the goods. It will be seen that, using the pallet-securing means of the present invention, the pallets can be held down firmly onto the floor of the container and there is no necessity to provide a rigid structure, e.g. a crate or framework, secured on the pallet and wedged down from the roof of the container, as would be the conventional packaging technique.

DESCRIPTION OF THE PREFERRED EMBODIMENTS

Figure 3:
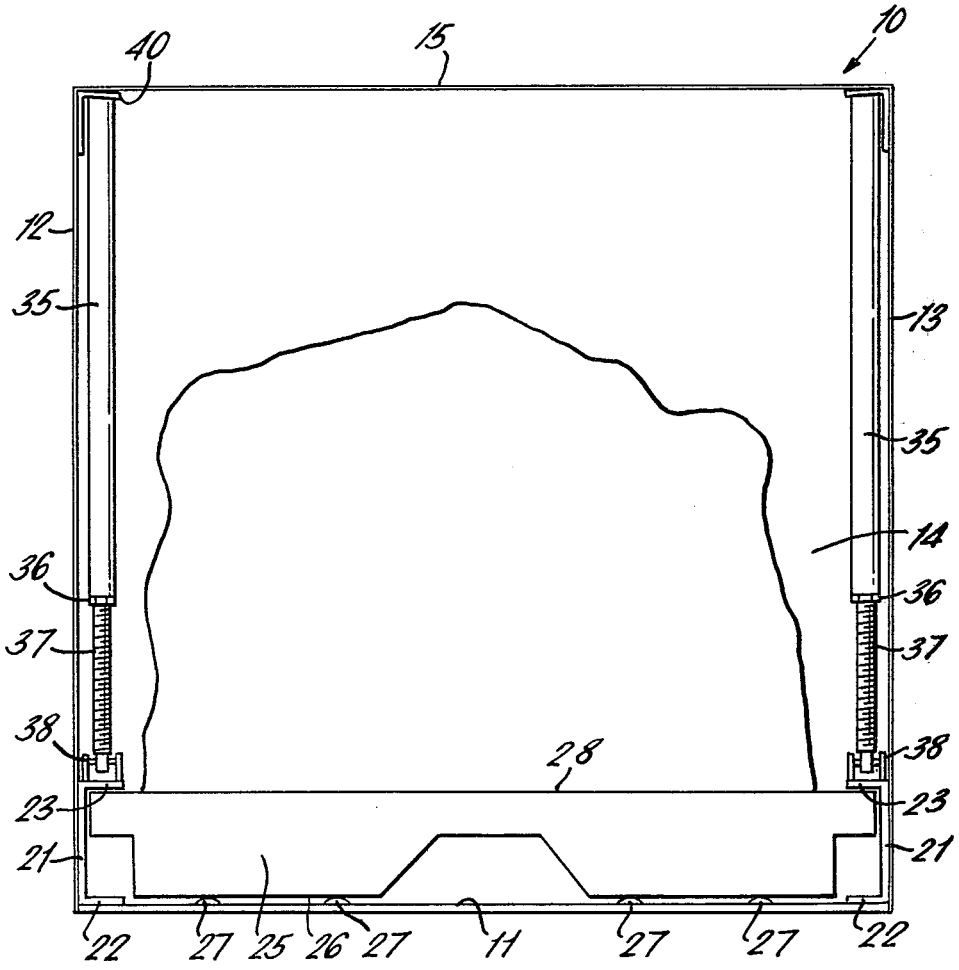
FIG. 3 is an end view of the container of FIG. 1 with a closure door removed showing a loaded pallet secured in the container by the pallet-securing means.

Referring to the drawings there is shown a container 10 having a rectangular floor 11, side walls 12, 13, an end wall 14 and a top or roof 15. This container would normally be a standard size container, for example an I.S.O. container and the pallet-securing means, although removable therefrom, would be adapted to fit any container to the same standard dimensions. These pallet-securing means include two pallet retaining channels 20, 21 which are arranged, one on each side of the container, to extend along the length thereof, the channels lying against the side walls and facing one another, each channel having a lower flange 22 resting on the floor of the container and an upper flange 23 spaced above the floor of the container. Each channel 20, 21 extends the full length of the container. The spacing between the two flanges 22, 23 on each channel is made sufficient that a pallet can slide along the floor 11 of the container or along the lower flange 22, according to the shaping of the pallet, and to fit under and be retained by the upper flange 23 so that the pallet is held against vertical movement. One construction of pallet is shown in FIG. 3 where a pallet 25 has a lower surface 26 for sliding over rubbing strips 27 on the floor of the container. In this particular pallet, the upper surface 28 is wider than the base and extends underneath the aforementioned flanges 23 on the channels 20, 21.

Although it is convenient to use channel members, it would be possible to use angle bars, each angle bar lying against one side wall of the container and having its flange extending inwardly at the appropriate height above the floor of the container.

Figure 1:
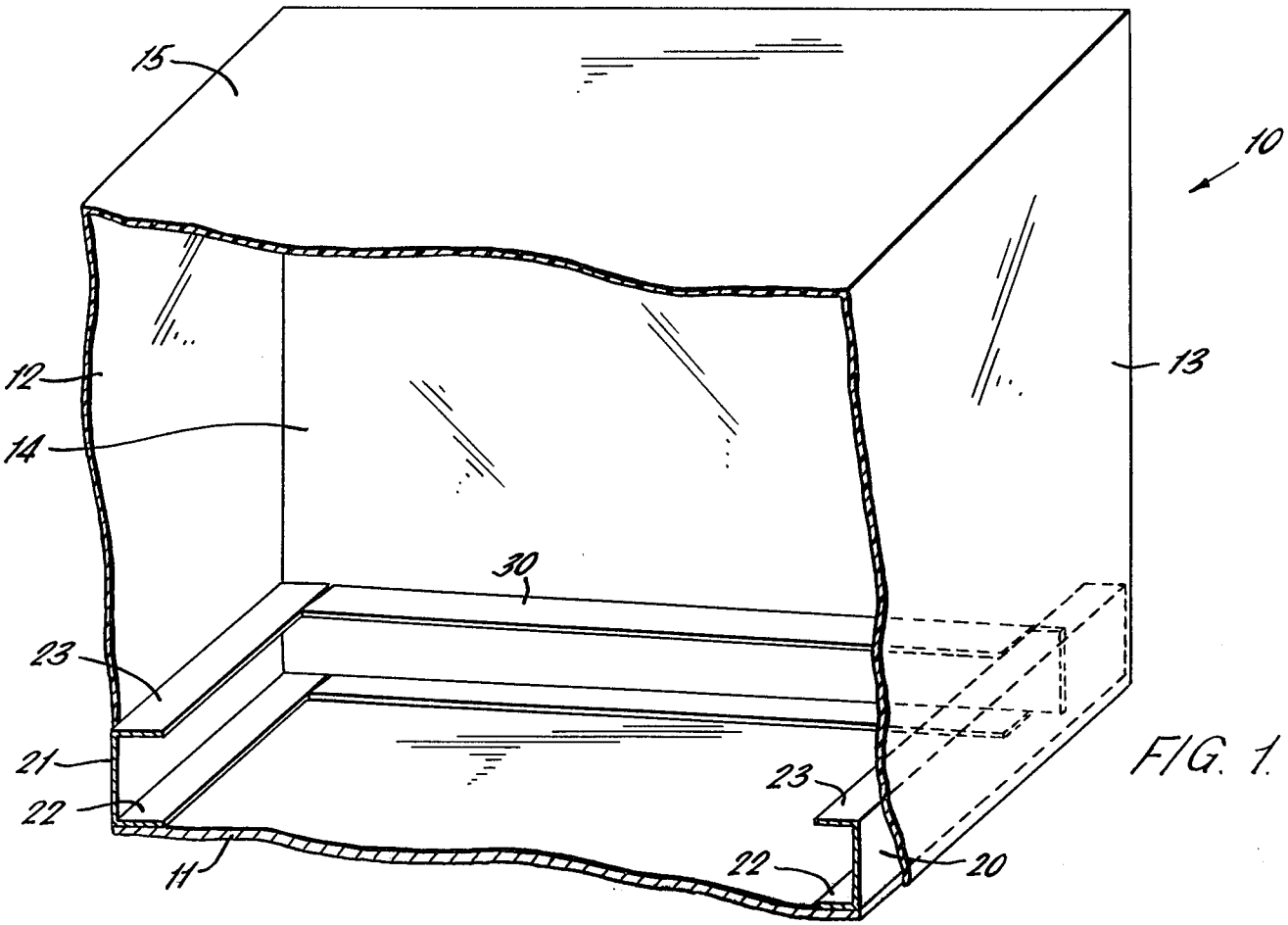
FIG. 1 is a broken-away perspective view illustrating part of a container and of pallet-securing means within the container forming one embodiment of the invention.

The two channels 20,21 are held spaced apart by an end spreader bar 30 as shown in FIG. 1. This spreader bar may be a rigid member of sufficient length such that, when it is put straight across the end of the container between the channels 20, 21, it holds these channels against the side walls 12, 13 of the container. Such a spreader bar 30 may readily be put into the container slightly askew and then straightened out to tighten the channels 20, 21 against the side walls.

Figure 2:
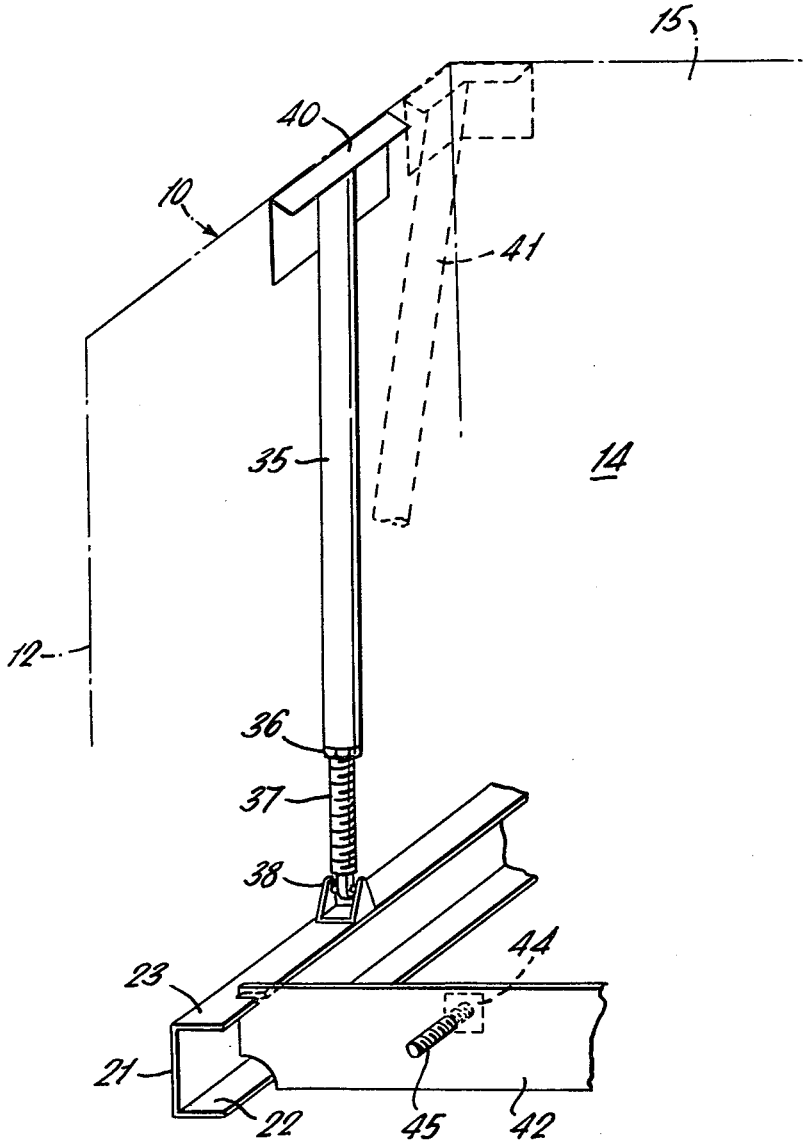
FIG. 2 is another broken-away perspective view illustrating part of the container of FIG. 1 together with further features of the pallet-securing means.

Each channel 20, 21 is held down onto the floor 11 of the container by one or more support props. Such a prop is shown for example in FIG. 2 and comprises a strut 35 with a screw collar 36 at its lower end engaging a jacking screw 37 which is pivotally secured to the upper flange 23 of the channel member by means of a pivot 38. At its upper end, the strut 35 carries a spreader plate or runner 40 forming a pad which engages the roof 15 of the container and, in this particular example, also engages the side wall 12 of the container. The spreader plate may have a roughened or knurled surface for ensuring a good frictional grip. By adjustment of the screw collar 36, the strut 35 can be lengthened so that the spreader plate 40 is forced tightly against the roof 15 of the container, so holding the channel 20 down on the floor. The pivot 38 is used for convenience of storage when the pallet supporting means are removed from a container, the pivot enabling the strut 35 to lie flat on the channel member. It may be preferred in some cases to position the strut 35 at an angle, for example to enable the spreader plate to fit into a corner of the container as shown in dashed lines at 41 in FIG. 2. Two or more such struts 35 may, if desired, be provided on each channel 20, 21; this may be desirable with large containers. In some cases, a single spreader plate 40 may be carried on two separate struts extending from the pad to spaced points on the channel member.

After pallets have been put in the container, they are secured therein by a closure 42 (FIG. 2) which extends between the two channels 20, 21 and, in this particular embodiment, is dropped into slots 43 in the upper flange 23. A number of such slots may be spaced along the length of the channels in suitable positions for retaining a part load, if the container is large enough to accommodate several pallets.

If desired adjustable abutments 44, e.g. on threaded rods 45, may be provided for ensuring that the pallet or pallets are tightly pressed against the spreader bar 30 or other end strip.

It will be noted that the pallet-securing means may be made so as to fit any container having the same internal dimensions. No modification of the container is required. The pallets are held against longitudinal movement by the spreader bar 30 and closure 42. The channels 20, 21 prevent sideways movement. Upward movement is prevented by the props 35 holding down the channels 20, 21 which, by their upper flanges 23, hold down the pallet.

If two rows of pallets are to be carried, a centre bar may be provided with outwardly directed flanges on both sides, this bar fitting into the spreader bar 30 to be located thereby and also engaging the end closure 42. In this case, it may be convenient to provide two end closures, each extending between a channel 20 or 21 and the centre bar.

Although in the above-described construction, the channel members 20 and 21 extend for the full length of the container, it is alternatively possible to have two or more channel or angle members on each side of the container, each extending only for part of the length of the container. In this case further spreader bars 30 and/or closures 42 and props 35 would be provided to ensure that all the channel members or angle members are held in position.

I claim:

1. Pallet-securing means for fitting within a container of predetermined dimensions and rectangular in plan to secure therein one or more pallets of predetermined dimensions, which pallet-securing means comprise flanged members adapted to extend along the length of the floor of the container on each side thereof with the flanges extending inwardly towards one another above floor level, which flanges are at a height above the floor level to permit of a pallet or pallets sliding under a flange on each flanged member to be retained against upward movement thereby, a first cross-member adapted to be inserted between the flanged members at one end of the container to hold the flanged members against the respective side walls of the container, props arranged between each flanged member and a respective pad or pads adapted for bearing against the roof of the container for holding the flanged member down onto the floor of the container and at least one closure element adapted to be secured between the flanged members to form a second cross-member spaced from said first cross-member.

2. Pallet securing means as claimed in claim 1 wherein each said prop is adjustable.

3. Pallet securing means as claimed in claim 2 wherein said prop is a screw jack.

4. Pallet adjusting means as claimed in claim 1 wherein each prop has a pad for engaging the roof of the container.

5. Pallet-securing means as claimed in claim 1 wherein each prop is pivotally secured on a flanged member.

6. Pallet-securing means as claimed in claim 1 wherein adjusting means are provided on the first cross-member to enable it to be tightened against the flanged members.

7. Pallet-securing means as claimed in claim 1 wherein the flanged members are channel members.

8. Pallet-securing means as claimed in claim 1 wherein the flanged members have slots to receive the closure member.

9. Pallet-securing means as claimed in claim 1 wherein threaded adjusting means are provided on the closure member to enable the pallets to be tightly compressed towards the far end of the container after the closure member has been secured in position.

10. Pallet-securing means as claimed in claim 1 and having two flanged members each adapted to extend along substantially the whole length of the floor of the container, one on each side thereof.

11. A container having a floor, side walls and roof and rectangular in plan in combination with pallet-securing means for fitting within the container to secure therein one or more pallets or predetermined dimensions, which pallet-securing means comprise flanged members adapted to extend along the length of the floor of the container on each side thereof with the flanges extending inwardly towards one another above floor level, which flanges are at a height above the floor level to permit of a pallet or pallets sliding under a flange on each flanged member to be retained against upward movement thereby, a first cross-member adapted to be inserted between the flanged members at one end of the container to hold the flanged members against the respective side walls of the container, props arranged between each flanged member and a respective pad or pads adapted for bearing against the roof of the container for holding the flanged member down onto the floor of the container and at least one closure element adapted to be secured between the flanged members to form a second cross-member spaced from said first cross-member.

12. A container as claimed in claim 11 wherein the first cross-member is a spreader dimensioned to be a force fit between the flanged members when the latter are positioned in the container on the floor thereof against the side walls.

13. A container as claimed in claim 11 and containing at least one pallet of the kind having an impermeable pallet with an impermeable flexible cover sheet sealed to the pallet whereby the space between the cover sheet and the goods may be partially evacuated so that the cover is pressed down by air pressure to hold the goods tightly on the pallet.

* * * * *